US010731887B2

(12) United States Patent
DeTommasi et al.

(10) Patent No.: US 10,731,887 B2
(45) Date of Patent: Aug. 4, 2020

(54) TOOLCHAIN FOR HVAC SYSTEM DESIGN CONFIGURATION

(71) Applicant: Carrier Corporation, Palm Beach Gardens, FL (US)

(72) Inventors: Luciano DeTommasi, Cork (IE); El Hassan Ridouane, Cork (IE); Cemalettin Ozturk, Cork (IE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/288,510

(22) Filed: Feb. 28, 2019

(65) Prior Publication Data

US 2019/0285302 A1 Sep. 19, 2019

Related U.S. Application Data

(60) Provisional application No. 62/644,641, filed on Mar. 19, 2018.

(51) Int. Cl.
*F24F 11/49* (2018.01)
*F24F 11/65* (2018.01)
(Continued)

(52) U.S. Cl.
CPC ..... *F24F 11/49* (2018.01); *F24F 11/46* (2018.01); *F24F 11/65* (2018.01); *F24F 2140/50* (2018.01); *F24F 2140/60* (2018.01)

(58) Field of Classification Search
None
See application file for complete search history.

(56) References Cited

U.S. PATENT DOCUMENTS 8,583,531 B2 11/2013 Hirl
9,310,403 B2 4/2016 Brackney et al.
(Continued)

FOREIGN PATENT DOCUMENTS

EP 2858015 4/2015

OTHER PUBLICATIONS

A. McGibney, et al., "A Systematic Engineering Tool Chain Approach for Self-organizing Building Automation Systems," IEEE 2013, 6 pages.

(Continued)

*Primary Examiner* — Ryan A Jarrett
(74) *Attorney, Agent, or Firm* — Cantor Colburn LLP

(57) ABSTRACT

A system is provided that includes one or more processing resources operable to execute instructions to determine one or more base load profiles associated with one or more buildings and modify the one or more base load profiles based on a new set of building envelope parameter options that vary at least one building envelope feature. The one or more base load profiles are matched with a plurality of heating, ventilation, and air conditioning (HVAC) equipment profiles to define HVAC configuration options. Control configurations are determined for the HVAC configuration options. A simulation of the control configurations is executed on models of the HVAC configuration options to determine one or more performance indicators. An assessment is output of the one or more performance indicators associated with the control configurations and the HVAC configuration options for the one or more buildings.

20 Claims, 4 Drawing Sheets

(51) Int. Cl.
*F24F 11/46* (2018.01)
*F24F 140/60* (2018.01)
*F24F 140/50* (2018.01)

(56) References Cited

U.S. PATENT DOCUMENTS

| | | | | |
|---|---|---|---|---|
| 9,442,470 | B2 | 9/2016 | Noureldin et al. | |
| 2011/0246381 | A1* | 10/2011 | Fitch | G06Q 10/04 705/313 |
| 2011/0313578 | A1* | 12/2011 | Jones | G06F 30/13 700/291 |
| 2014/0129197 | A1* | 5/2014 | Sons | G06F 30/13 703/7 |
| 2014/0303796 | A1 | 10/2014 | Jeong et al. | |
| 2016/0229521 | A1 | 8/2016 | De Miranda Cara et al. | |
| 2018/0259918 | A1* | 9/2018 | Asmus | G05B 15/02 |

OTHER PUBLICATIONS

G. Giannakis, et al., "Simulation-time Reduction Techniques for a Retrofit Planning Tool," Building Simulation 2017, 10 pages.

G. Hernandez, et al., Design of energy efficiency retrofitting projects for districts based on performance optimization of District Performance Indicators calculated through simulation models, Energy Procedia 122 (2017) pp. 721-726.

M. Levine, et al., "A Retrofit Tool for Improving Energy Efficiency of Commerical Buildings," Aug. 2012 ACEEE Summer Study on Energy Efficiency in Buildings, 12 pages.

P. Steskens, et al., "A decision making tool for the energy efficient refurbishment of residential buildings," Energy Procedia 78 (2015) pp. 997-1002.

Perkins+Will, Research Journal, vol. 08.01, Sustainable and Energy Efficient Commercial Retrofit, A. Abdullah, 2016, 20 pages.

ReFoMo, "Review on techiques, tools and best practices for energy efficient retrofitting of heritage buildings," Copernicus Institute for Substainable Development, Utrecht University, J. Rosales Carreon, Jun. 2015, 45 pages.

Z. Wu, et al., "Large-scale building energy efficiency retrofit: Concept, model and control," Postprint submitted to Energy, Mar. 23, 2016, 17 pages.

* cited by examiner

TOOLCHAIN FOR HVAC SYSTEM DESIGN CONFIGURATION

CROSS-REFERENCE TO RELATED APPLICATION

This application claims the benefit of priority to U.S. Provisional Application Ser. No. 62/644,641 filed Mar. 19, 2018, the disclosure of which is incorporated herein by reference in its entirety.

BACKGROUND

The subject matter disclosed herein generally relates to the field of heating, ventilation, and air conditioning (HVAC) systems, and more particularly to a toolchain for HVAC system design configuration.

Design, installation, assessment, and commissioning of HVAC systems, in a building or a district including multiple buildings, is often based solely on expert knowledge. Similarly, retrofit designs of HVAC systems in existing buildings typically rely upon expert knowledge of available options that are compatible with building infrastructure. Expert knowledge may be limited or incomplete given the number of possible configuration variations, environmental considerations, and control options.

BRIEF DESCRIPTION

In accordance with one or more embodiments, a system is provided that includes an energy conservation measures database system, one or more processing resources, and one or more memory resources storing executable instructions. The executable instructions when executed by the one or more processing resources cause system to determine one or more base load profiles associated with one or more buildings and modify the one or more base load profiles based on a new set of building envelope parameter options that vary at least one building envelope feature. The one or more base load profiles are matched with a plurality of heating, ventilation, and air conditioning (HVAC) equipment profiles from the energy conservation measures database system to define a plurality of HVAC configuration options. A plurality of control configurations is determined for the HVAC configuration options. A simulation of the control configurations is executed on a plurality of models of the HVAC configuration options to determine one or more performance indicators. An assessment of the one or more performance indicators associated with the control configurations and the HVAC configuration options for the one or more buildings is output.

In addition to one or more of the features described above or below, or as an alternative, further embodiments may include where the control configurations are selected based on mapping a plurality of control options from the energy conservation measures database system to the HVAC equipment profiles in the HVAC configuration options.

In addition to one or more of the features described above or below, or as an alternative, further embodiments may include where the executable instructions when executed by the one or more processing resources cause the system to apply a parameter calibration to adjust the one or more base load profiles.

In addition to one or more of the features described above or below, or as an alternative, further embodiments may include where the executable instructions when executed by the one or more processing resources cause the system to apply the parameter calibration to adjust the models of the HVAC configuration options.

In addition to one or more of the features described above or below, or as an alternative, further embodiments may include where the one or more base load profiles include at least one thermal load and at least one electrical load for each configuration of the one or more buildings.

In addition to one or more of the features described above or below, or as an alternative, further embodiments may include where the at least one building envelope feature includes one or more of: a window configuration, an insulation configuration, and a building material configuration.

In addition to one or more of the features described above or below, or as an alternative, further embodiments may include where the control configurations define one or more variations in baseline set points, schedule adjustments, load sharing between a plurality of HVAC components, and environmental condition variations.

In addition to one or more of the features described above or below, or as an alternative, further embodiments may include where the performance indicators are selectable between one or more of: energy consumption, comfort level, energy cost, Return of Investment, and payback period.

In addition to one or more of the features described above or below, or as an alternative, further embodiments may include where the models are defined at two or more levels of complexity to capture fundamental physical behavior with a reduced computational complexity to lower resource consumption during execution of the simulation.

In addition to one or more of the features described above or below, or as an alternative, further embodiments may include where the simulation of the control configurations is selectable between an open loop response and a closed loop response.

In accordance with one or more embodiments, a method is provided. The method includes determining, by a processing system, one or more base load profiles associated with one or more buildings. The processing system can modify the one or more base load profiles based on a new set of building envelope parameter options that vary at least one building envelope feature. The processing system can match the one or more base load profiles with a plurality of HVAC equipment profiles from the energy conservation measures database system to define a plurality of HVAC configuration options and determine a plurality of control configurations for the HVAC configuration options. The processing system can execute a simulation of the control configurations on a plurality of models of the HVAC configuration options to determine one or more performance indicators and output an assessment of the one or more performance indicators associated with the control configurations and the HVAC configuration options for the one or more buildings.

Technical effects of embodiments of the present disclosure include HVAC component and control selections that enhance overall HVAC system performance for a target environment using automated generation and evaluation of design configurations including building envelope parameters, HVAC and controls energy conservation measures selection for one or more buildings based on desired performance indicators. Execution of the simulations can use reduced computer system resources based on model complexity selection and closed/open loop simulation selection.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
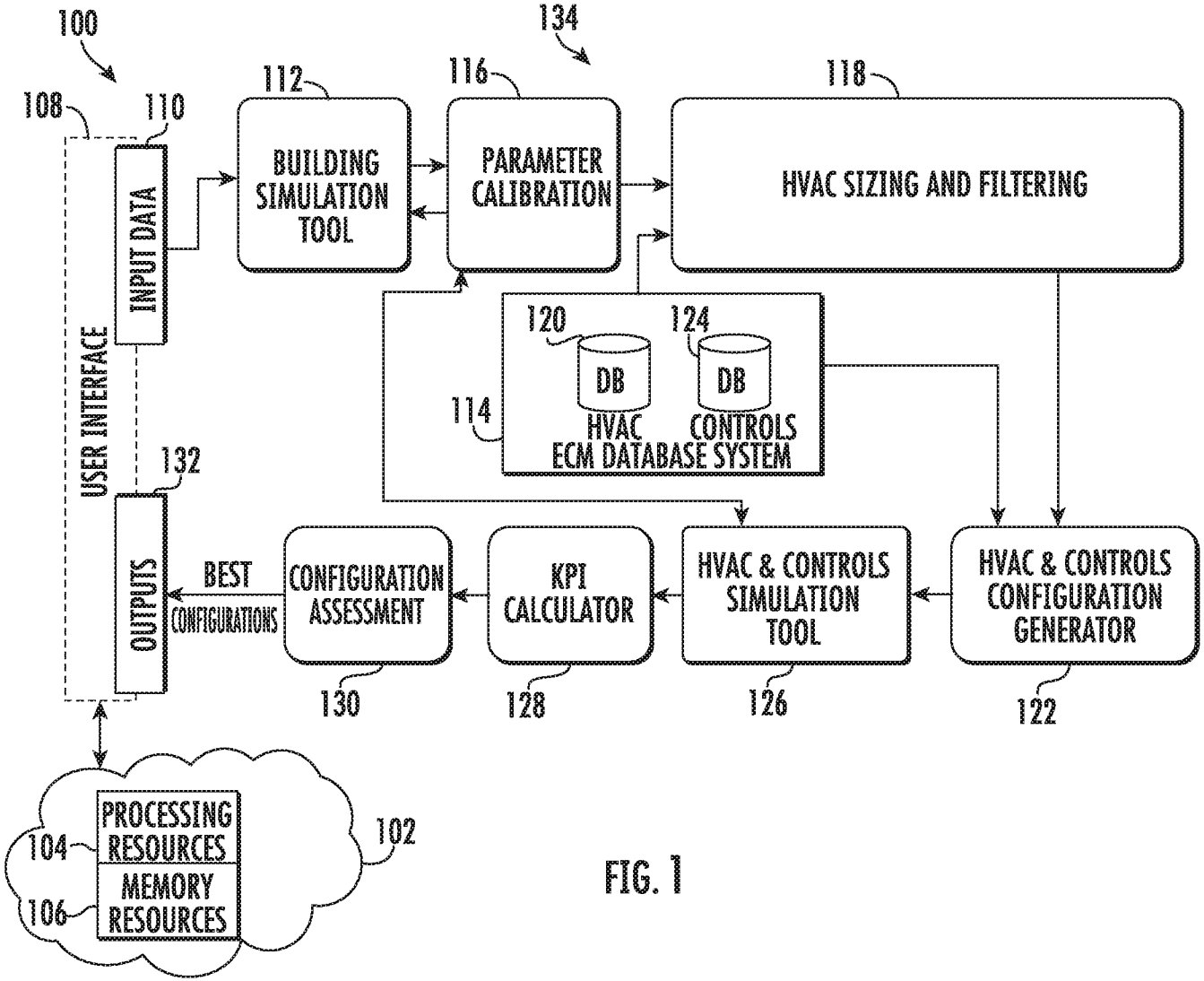
FIG. 1 depicts a system in accordance with one or more embodiments.

A detailed description of one or more embodiments of the disclosed apparatus and method are presented herein by way of exemplification and not limitation with reference to the Figures.

Embodiments disclosed herein may include a system, method, and/or computer program product for a toolchain for heating, ventilation, and air conditioning (HVAC) system design configurations that consider multiple building envelope options and HVAC energy conservation measures (ECMs) for one or more buildings along with control configurations. Embodiments provide an evaluation of performance indicators to assist in selecting an HVAC design configuration with corresponding controls.

In embodiments, multiple configurations can be generated for building and district construction and retrofit designs based on a combination of building envelope parameters, HVAC and control measures and evaluation of a comprehensive set of performance indicators. Building envelope parameters may include upgrades to a building envelope, such as internal and external insulation of a building facade, thermal mass and infiltration. HVAC ECMs may include installation of new HVAC components/systems or replacement of existing units. Associated to HVAC ECMs are a number of control ECMs which can determine how the overall system is controlled to assure efficient operation. This may include effects of changes to predefined (baseline) set-points, energy consumption (load) sharing between different supply units, as well as environmental conditions variations. In this way, multi-domain performance indicators (e.g., energy-based, comfort-based and economic-based aspects) can be jointly analyzed and evaluated with the objective to maximize the impact of new systems and/or the retrofit systems.

Baseline performance indicators can be calculated based on a current system prior to a retrofit. Retrofitting or new construction goals can be established, and an ECM catalog of known components, performance parameters, and control configurations can be used to define configurations for comparison. For energy and comfort-related parameters depending on the interdependency of the systems, multiple building-level simulations may be issued, or if there is a stronger coupling, then district-level simulations may be issued for multiple buildings in close physical proximity. Although models are designed to predict the real behavior of buildings and the associated HVAC systems as accurately as possible, model predictions may differ from measured values, for instance, because of: sensor measurement errors, modeling insufficiencies, or incorrect model parameter value estimations. Model calibration can be performed using past sensor measurements in order to change uncertain model parameter values. Aggregated models can be derived from calibration of reduced order models on historic data or on more detailed simulation models. Once model parameters have been identified, a model can be used to explore behavior of a district or building under different operating conditions.

Specific characteristics of a building physics model can depend on the level of accuracy that a user is targeting. In particular, the level of accuracy of adopted simulation models can enable the identification of possible opportunities for improvements in energy efficiency. Common input data to detailed simulation models may include geometry, envelope materials, equipment and appliances, climate conditions, occupancy schedules and equipment use. Simulation models have the capability of determining the energy consumption of each end-user and as such can identify areas of improvement. As energy consumption is calculated, a simulation-based approach enables a determination of total energy consumption and operation cost for district-scale energy systems without relying on historical data.

Turning now to FIG. 1, a system 100 is depicted in accordance with one or more embodiments. The system 100 can include a processing system 102 with processing resources 104 operably coupled to memory resources 106. The processing resources 104 can include any number or type of processor operable to execute instructions. For example, the processing system 102 can be implemented as a single computer or a network of computers (e.g., a cloud processing system) operable to perform the processes as further described herein. The memory resources 106 can include volatile and non-volatile memory devices for storing instructions as a computer program product executable by the processing resources 104 and supporting data. The memory resources 106 are an example of a tangible storage medium readable by the processing resources 104, where software is stored as instructions for execution by the processing resources 104 to cause the system 100 to operate as described herein.

The processing system 102 can provide or be operably coupled to a user interface 108, such as a graphical user interface, on a display device that may be incorporated with or separate from the processing system 102. The user interface 108 enables entry of inputs 110 to a building simulation tool 112. The building simulation tool 112 can simulate a number of building envelope performance options entered directly, as parameters, by the user through the user interface 108 as inputs 110. The building simulation tool 112 can be used to define various combinations and configurations of modifications to a baseline building design, including, for example, changes to window type, room sizes, insulation, roofing, and other such parameters. Parameter calibration 116 can be used to modify and fine tune simulation values. For instance, on a retrofit application, sensors can be placed in a building to monitor the rate of heat loss, heat change, solar heating effects, and other values to verify and/or adjust simulation values. In some embodiments, the building simulation tool can define expected thermal loads and/or electrical loads. After parameter calibration 116, if performed, HVAC sizing and filtering 118 can access HVAC data 120 as HVAC ECM data from an ECM database system 114 to perform matching of simulated thermal and electrical loads from the building simulation tool 112 with known HVAC components and systems. Examples of HVAC data 120 can include device profiles for air handling units, vents, ductwork, variable air volume units, plumbing, chillers, boilers, condensers, electric heating elements, fans, and other such components and subsystems known in the art. As various permutations and combinations are identified, the HVAC sizing and filtering 118 can sort and reduce options that are more or less desirable compared to sorting criteria. For instance, configurations with a resulting system-level efficiency value below a desired threshold can be eliminated from further consideration.

An HVAC and controls configuration generator 122 can receive results from the HVAC sizing and filtering 118 and apply control ECM data 124 from the ECM database system 114 to generate a combination of control configurations for various HVAC system configurations. The control ECM data 124 can define control elements and sensors along with control algorithms to operate HVAC components. For example, the control ECM data 124 can define set points, transitions, load balancing, and other such control parameters. An HVAC and controls simulation tool 126 is operable to execute models defined through the HVAC and controls configuration generator 122. In some embodiments, calibrated parameters from parameter calibration 116 are provided to the HVAC and controls simulation tool 126 to further fine tune the simulation accuracy in view of observed differences between models and system performance results. The HVAC and controls simulation tool 126 may operate in an open loop or a closed loop mode. For example, performance observations while a simulation is executing may be captured but not fed back to further adjust system performance in an open loop mode. Alternatively, performance observations, such as slow responsiveness, excess energy consumption, and other factors observed during model execution can be used to further refine control system performance to enhance one or more parameters during operation in a closed loop mode. Results of the HVAC and controls simulation tool 126 are provided to a key performance indicator (KPI) calculator 128 to determine a performance score for each completed simulation with reference to the building envelope parameters and HVAC and control ECM components used in the corresponding configuration. KPIs can be computed for one or more buildings and may be in terms of energy usage, cost, environmental impact, expected system noise, and other such performance indicators. A configuration assessment tool 130 can analyze and compare KPI results to identify the best configurations for a selected KPI type. Outputs 132 of the configuration assessment tool 130 can be displayed at the user interface 108. Collectively, the building simulation tool 112, parameter calibration 116, HVAC sizing and filtering 118, HVAC and controls configuration generator 122, HVAC and controls simulation tool 126, KPI calculator 128, and configuration assessment tool 130 may be referred to as a toolchain 134 for HVAC design configuration.

Figure 2:
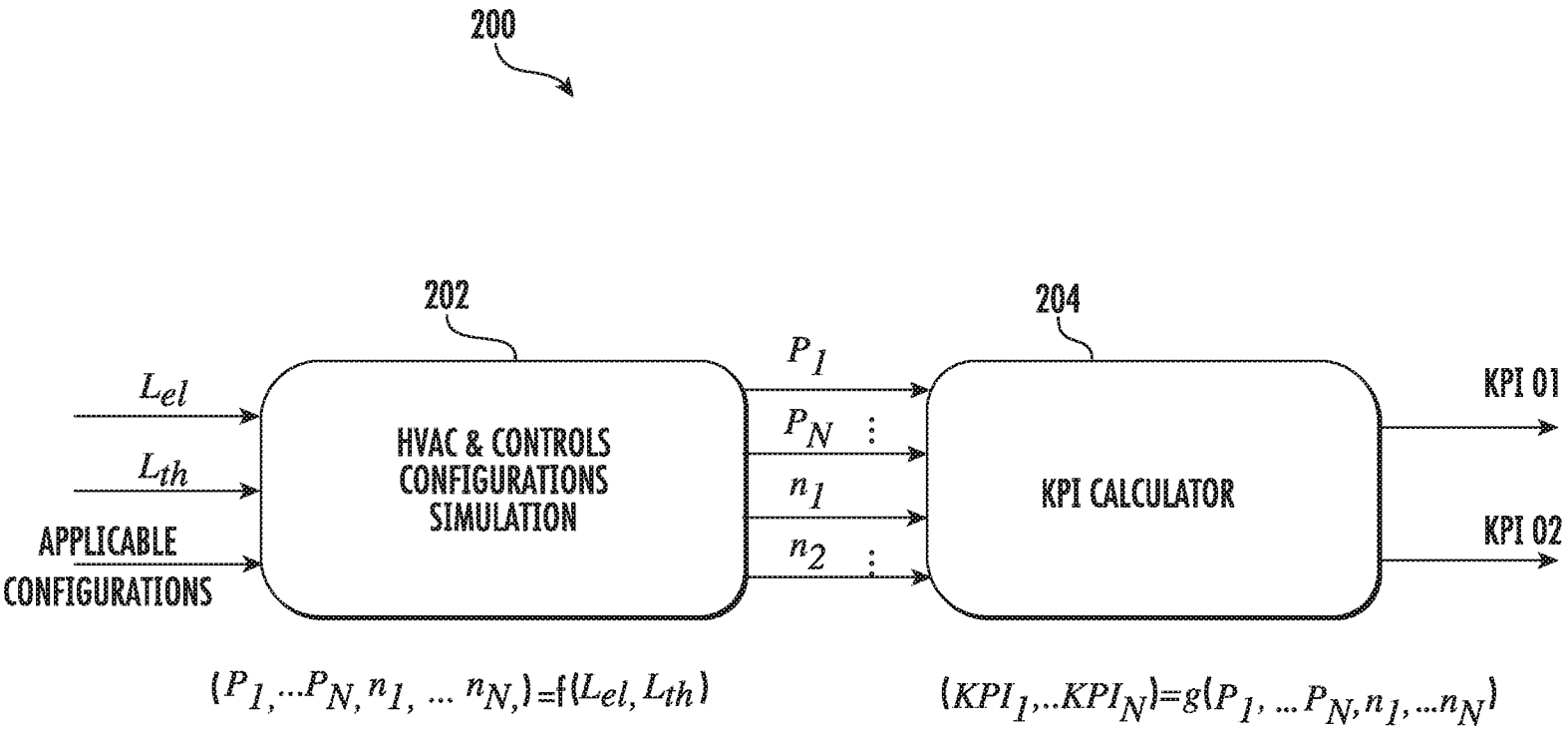
FIG. 2 depicts a simulation and key performance indicator calculation data flow in accordance with one or more embodiments.

Turning now to FIG. 2, a simulation and KPI calculation data flow 200 is depicted according to an embodiment. The simulation and KPI calculation data flow 200 represents an alternate embodiment of a portion of the toolchain 134 of FIG. 1. The simulation and KPI calculation data flow 200 includes a HVAC and controls configurations simulation 202 and a performance indicator calculator 204. In the example of FIG. 2, the performance indicator calculator 204 produces district key performance indicators for multiple buildings. The simulation and KPI calculation data flow 200 can be used to compute district KPIs in two phases. The HVAC and controls configurations simulation 202 receives one or more profiles of electrical ($L_{e1}$) and thermal ($L_{th}$) loads and returns electrical/thermal powers supplied by each HVAC ECM ($P_1, \ldots, P_N$) along with corresponding efficiencies ($\eta_1, \ldots \eta_N$). Based on the computed power supplies and efficiencies, in performance indicator calculator 204, the desired set of district KPIs is computed using corresponding equations. The flow in FIG. 2 can apply to both pre-retrofit configuration and retrofitted. Improvements with respect to the pre-retrofit configuration can be detected by variation in district KPIs, such as energy consumption, comfort level, and energy cost.

Figure 3:
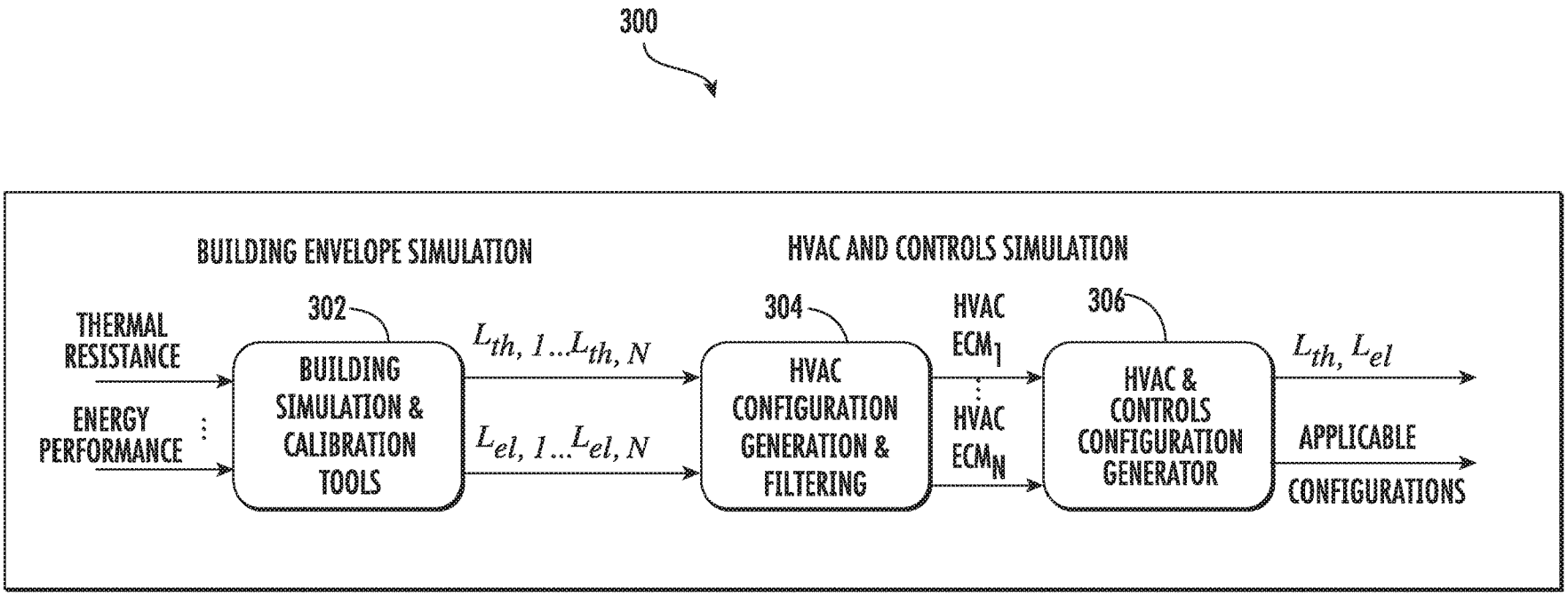
FIG. 3 depicts a configuration generation sequence data flow in accordance with one or more embodiments.

Turning now to FIG. 3, a configuration generation sequence data flow 300 is depicted according to an embodiment. The configuration generation sequence data flow 300 represents an alternate embodiment of a portion of the toolchain 134 of FIG. 1. The configuration generation sequence data flow 300 uses a combination of building envelope and energy performance parameters, HVAC and controls ECMs to produce thermal and electrical load profiles and a set of applicable HVAC and control configurations. The configuration generation sequence data flow 300 includes a building simulation program 302 that may be an embodiment of the building simulation tool 112 of FIG. 1, a calibration tool, an HVAC configuration generation and filtering 304, and an HVAC and controls configuration generator 306. The configuration generation sequence data flow 300 can be implemented as an automatic toolchain. The building simulation program 302 can receive building envelope parameters, such as thermal resistance and energy performance values, and produce thermal loads for the HVAC configuration generation and filtering 304. The thermal loads can correspond to the application of building envelope parameters data entered as inputs 110 through the user interface 108 of FIG. 1. HVAC and control ECMs can be generated by the HVAC configuration generation and filtering 304 and HVAC and controls configuration generator 306 taking information from the HVAC data 120 and control ECM data 124 of FIG. 1.

Figure 4:
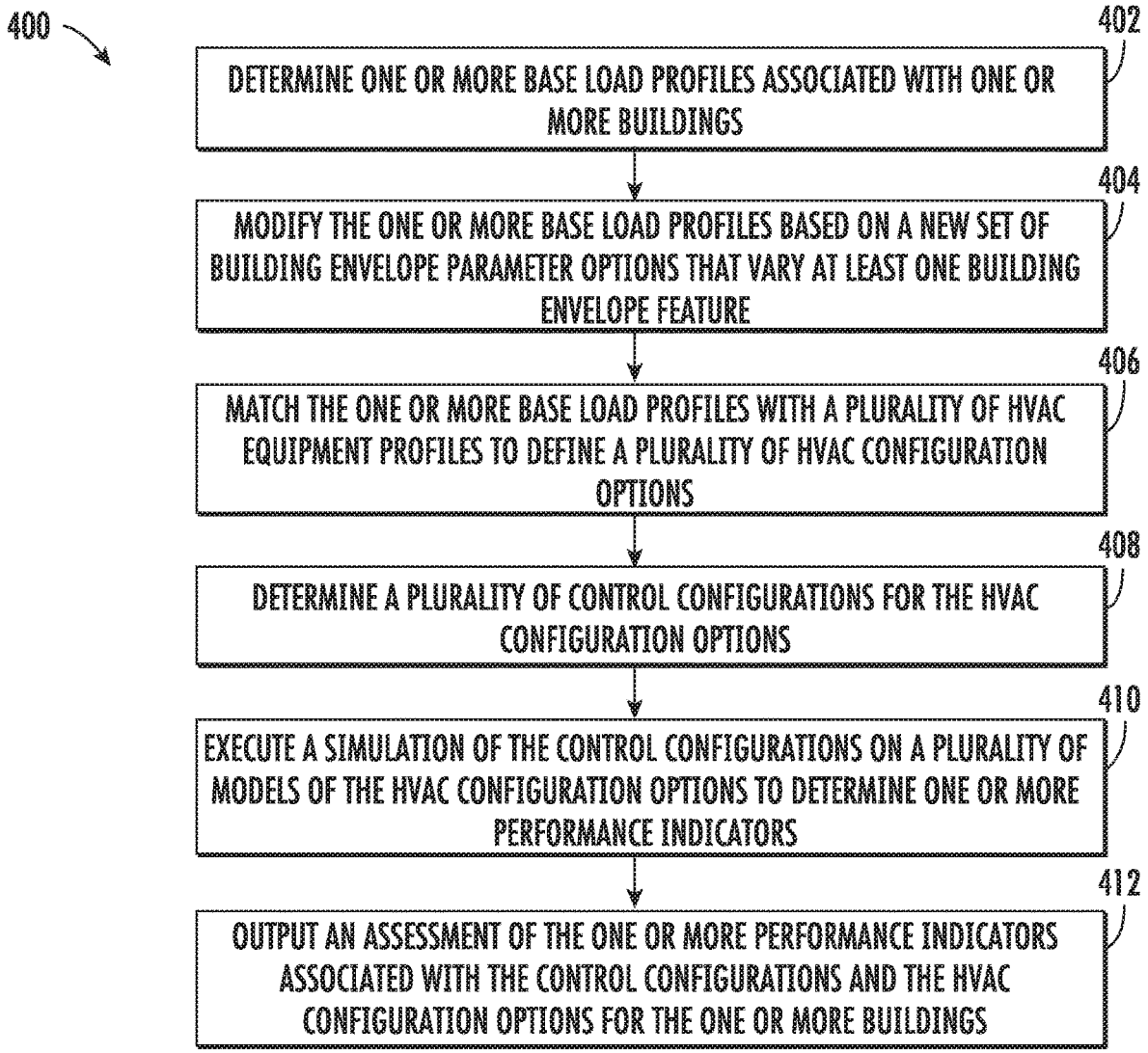
FIG. 4 depicts a process flow in accordance with one or more embodiments.

Turning now to FIG. 4, a process flow 400 that can be executed by the system 100 of FIG. 1 is depicted. The process flow 400 is described in reference to FIGS. 1-4 and may include additional steps beyond those depicted in FIG. 4.

At block 402, the system 100 determines one or more base load profiles associated with one or more buildings. The one or more base load profiles can include at least one thermal load and at least one electrical load for each configuration of the one or more buildings.

At block 404, the system 100 modifies the one or more base load profiles based on a new set of building envelope parameter options entered as inputs 110 through the user interface 108 (e.g., thermal resistance, window area, thermal mass) that vary at least one building envelope feature. The at least one building envelope feature can include one or more of: a window configuration, an insulation configuration, and a building material configuration. A parameter calibration 116 may also be applied to adjust the one or more base load profiles.

At block 406, the system 100 matches the one or more base load profiles with a plurality of HVAC equipment profiles (e.g., HVAC data 120) from the ECM database system 114 to define a plurality of HVAC configuration options. For instance, entries can include different types of HVAC equipment, different sizes of HVAC equipment, cost, performance parameters, and other capability indicators.

At block 408, the system 100 determines a plurality of control configurations for the HVAC configuration options. The control configurations can be selected based on mapping a plurality of control options from the ECM database system 114 (e.g., using HVAC data 120 and control ECM data 124) to the HVAC equipment profiles in the HVAC configuration options. The control configurations can define one or more variations in baseline set points, schedule adjustments, load sharing between a plurality of HVAC components, and environmental condition variations.

At block 410, the system 100 executes a simulation of the control configurations on a plurality of models of the HVAC configuration options to determine one or more performance indicators. The models can be defined at two or more levels of complexity to capture fundamental physical behavior with a reduced computational complexity to lower processing and memory resource consumption during execution of the simulation. Parameter calibration 116 may be applied to adjust the models of the HVAC configuration options. The simulation of the control configurations can be selectable between an open loop response and a closed loop response.

At block 412, the system 100 outputs an assessment of the one or more performance indicators associated with the control configurations and the HVAC configuration options for the one or more buildings. The performance indicators can be selectable between one or more of: energy consumption, comfort level, energy cost, Return of Investment, and payback period.

Embodiments herein can include a system, a method, and/or a computer program product at any possible technical detail level of integration. The computer program product may include a computer readable storage medium (or media) having computer readable program instructions thereon for causing a processor to carry out aspects of the embodiments herein.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the embodiments herein may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, to perform aspects of the embodiments herein.

Aspects of the embodiments herein are described herein with reference to flowchart illustrations and/or block diagrams of methods, apparatus (systems), and computer program products according to embodiments herein. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

Aspects of the embodiments are described herein with reference to flowchart illustrations, schematics, and/or block diagrams of methods, apparatus, and/or systems according to embodiments. Further, the descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system comprising:

an energy conservation measures database system;

one or more processing resources; and one or more memory resources storing executable instructions, wherein the executable instructions when executed by the one or more processing resources cause system to:

determine one or more base load profiles associated with one or more buildings;

modify the one or more base load profiles based on a new set of building envelope parameter options that vary at least one building envelope feature;

match the one or more base load profiles with a plurality of heating, ventilation, and air conditioning (HVAC) equipment profiles from the energy conservation measures database system to define a plurality of HVAC configuration options;

determine a plurality of control configurations for the HVAC configuration options;

execute a simulation of the control configurations on a plurality of models of the HVAC configuration options to determine one or more performance indicators; and output an assessment of the one or more performance indicators associated with the control configurations and the HVAC configuration options for the one or more buildings.

2. The system of claim 1, wherein the control configurations are selected based on mapping a plurality of control options from the energy conservation measures database system to the HVAC equipment profiles in the HVAC configuration options.

3. The system of claim 1, wherein the executable instructions when executed by the one or more processing resources cause the system to:

apply a parameter calibration to adjust the one or more base load profiles.

4. The system of claim 3, wherein the executable instructions when executed by the one or more processing resources cause the system to:

apply the parameter calibration to adjust the models of the HVAC configuration options.

5. The system of claim 1, wherein the one or more base load profiles comprise at least one thermal load and at least one electrical load for each configuration of the one or more buildings.

6. The system of claim 1, wherein the at least one building envelope feature comprises one or more of: a window configuration, an insulation configuration, and a building material configuration.

7. The system of claim 1, wherein the control configurations define one or more variations in baseline set points, schedule adjustments, load sharing between a plurality of HVAC components, and environmental condition variations.

8. The system of claim 1, wherein the performance indicators are selectable between one or more of: energy consumption, comfort level, energy cost, Return of Investment and payback period.

9. The system of claim 1, wherein the models are defined at two or more levels of complexity to capture fundamental physical behavior with a reduced computational complexity to lower resource consumption during execution of the simulation.

10. The system of claim 1, wherein the simulation of the control configurations is selectable between an open loop response and a closed loop response.

11. A method comprising:

determining, by a processing system, one or more base load profiles associated with one or more buildings;

modifying, by the processing system, the one or more base load profiles based on a new set of building envelope parameter options that vary at least one building envelope feature;

matching, by the processing system, the one or more base load profiles with a plurality of heating, ventilation, and air conditioning (HVAC) equipment profiles from the energy conservation measures database system to define a plurality of HVAC configuration options;

determining, by the processing system, a plurality of control configurations for the HVAC configuration options;

executing, by the processing system, a simulation of the control configurations on a plurality of models of the HVAC configuration options to determine one or more performance indicators; and outputting, by the processing system, an assessment of the one or more performance indicators associated with the control configurations and the HVAC configuration options for the one or more buildings.

12. The method of claim 11, wherein the control configurations are selected based on mapping a plurality of control options to the HVAC equipment profiles in the HVAC configuration options.

13. The method of claim 11, further comprising:

applying a parameter calibration to adjust the one or more base load profiles.

14. The method of claim 13, further comprising:

applying the parameter calibration to adjust the models of the HVAC configuration options.

15. The method of claim 11, wherein the one or more base load profiles comprise at least one thermal load and at least one electrical load for each configuration of the one or more buildings.

16. The method of claim 11, wherein the at least one building envelope feature comprises one or more of: a window configuration, an insulation configuration, and a building material configuration.

17. The method of claim 11, wherein the control configurations define one or more variations in baseline set points, schedule adjustments, load sharing between a plurality of HVAC components, and environmental condition variations.

18. The method of claim 11, wherein the performance indicators are selectable between one or more of: energy consumption, comfort level, energy cost, Return of Investment, and payback period.

19. The method of claim 11, wherein the models are defined at two or more levels of complexity to capture fundamental physical behavior with a reduced computational complexity to lower resource consumption during execution of the simulation.

20. The method of claim 11, wherein the simulation of the control configurations is selectable between an open loop response and a closed loop response.

* * * * *